US005836477A

United States Patent [19]

Yeh

[11] Patent Number: 5,836,477

[45] Date of Patent: Nov. 17, 1998

[54] BALL FEEDING DEVICE OF A BALL WASHING MACHINE

[76] Inventor: Ding-Tsai Yeh, 364, Pon-Yi Road, Tai-Ping, Taichung, Taiwan

[21] Appl. No.: 861,054

[22] Filed: May 21, 1997

[51] Int. Cl.[6] ..... A24F 27/14

[52] U.S. Cl. ..... 221/135; 221/278

[58] Field of Search ..... 221/135, 200, 221/201, 258, 278; 15/3, 300.1

[56] References Cited

U.S. PATENT DOCUMENTS 4,648,529 3/1987 Blakemore et al. ..... 221/135

*Primary Examiner*—Kenneth Noland
*Attorney, Agent, or Firm*—Browdy and Neimark

[57] ABSTRACT

A ball feeding device is mounted on the ball washer for feeding the dirty balls into the ball washer one by one. The ball feeding device is composed of a cylindrical body in which an upper plate, an intermediate plate, a lower plate, a suction apparatus, a first lobed wheel, a second lobed wheel, and a driving apparatus are housed. The dirty balls are drawn by the suction force into the cylindrical body such that the balls are first arranged in sequence in the first ball cells of the first lobed wheel, and that the balls are subsequently sent to the second ball cells of the second lobed wheel before they are selectively fed one by one into the ball washer.

12 Claims, 5 Drawing Sheets

BALL FEEDING DEVICE OF A BALL WASHING MACHINE

FIELD OF THE INVENTION

The present invention relates generally to a ball washing machine, and more particularly to a ball feeding device of the ball washing machine.

BACKGROUND OF THE INVENTION

There are a variety of game balls, which are ubiquitous in the ball parks, the playgrounds, the amusement parks, etc. The game balls soil easily; they should be therefore washed regularly. It is conceivably inefficient and time-consuming that the game balls are washed manually; especially in quantity. For this reason, the ball washing machine is used in place of the manual whasing of the game balls.

SUMMARY OF THE INVENTION

The primary objective of the present invention is to provide a ball washing machine with an improved ball feeding device capable of feeding a predetermined quantity of balls into the ball washing machine so as to improve the operational efficiency of the ball washing machine.

The foregoing objective of the present invention is attained by the ball feeding device, which consists of a hollow cylindrical body in which an upper plate, an intermediate plate, a lower plate, a suction apparatus, a first lobed wheel, a second lobed wheel, and a driving apparatus are housed. The suction force is generated by a fan.

The balls are drawn by the suction force into the cylindrical housing via a ball inlet such that the balls are arranged sequentially in the first ball cells of the first lobed wheel, and that the balls are subsequently drawn into the second ball cells of the second lobed wheel before they are fed into the ball washing machine via the ball feeding port of the ball washing machine.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
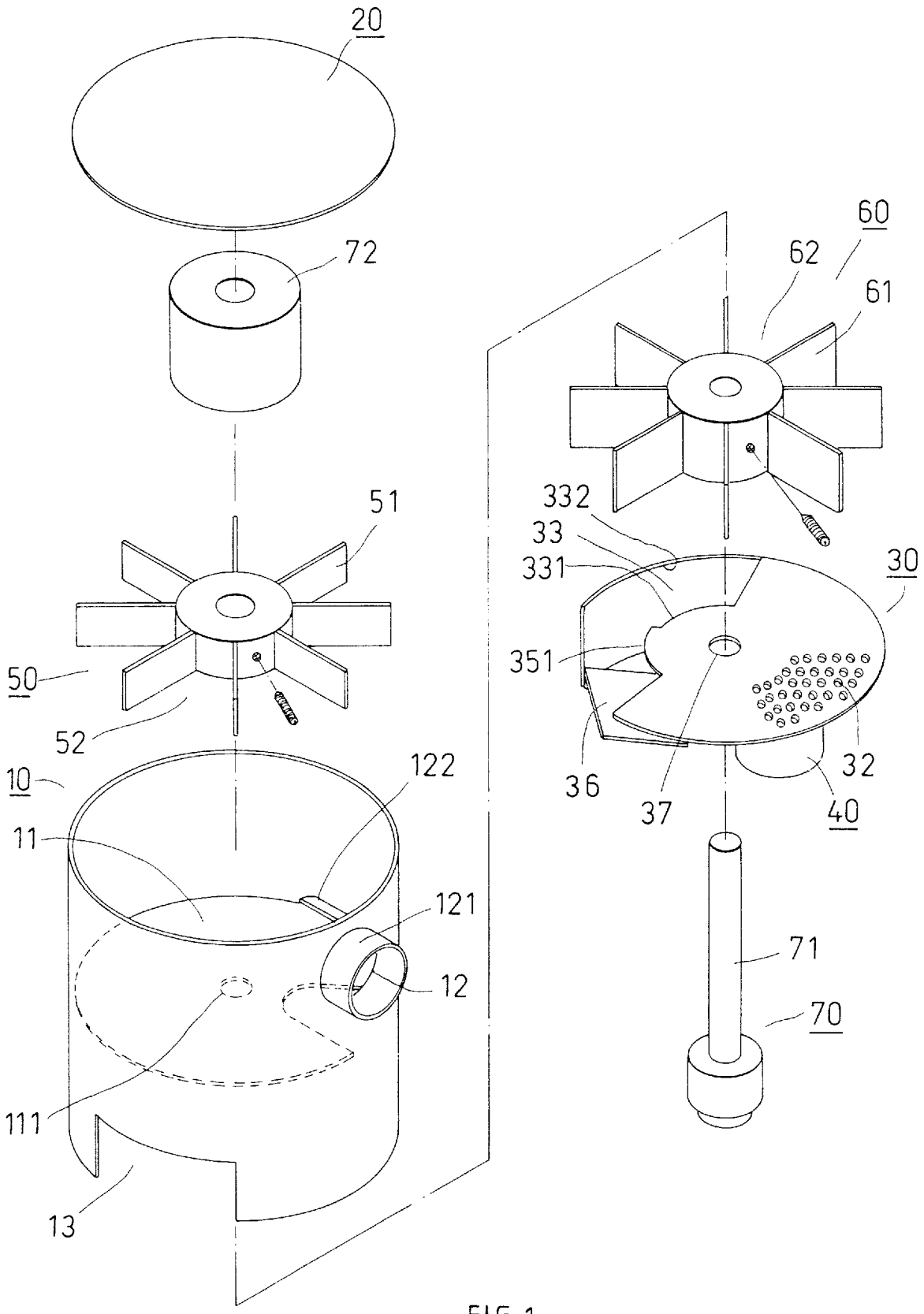
FIG. 1 is a partial exploded view of a ball feeding device embodied in the present invention.
Figure 2:
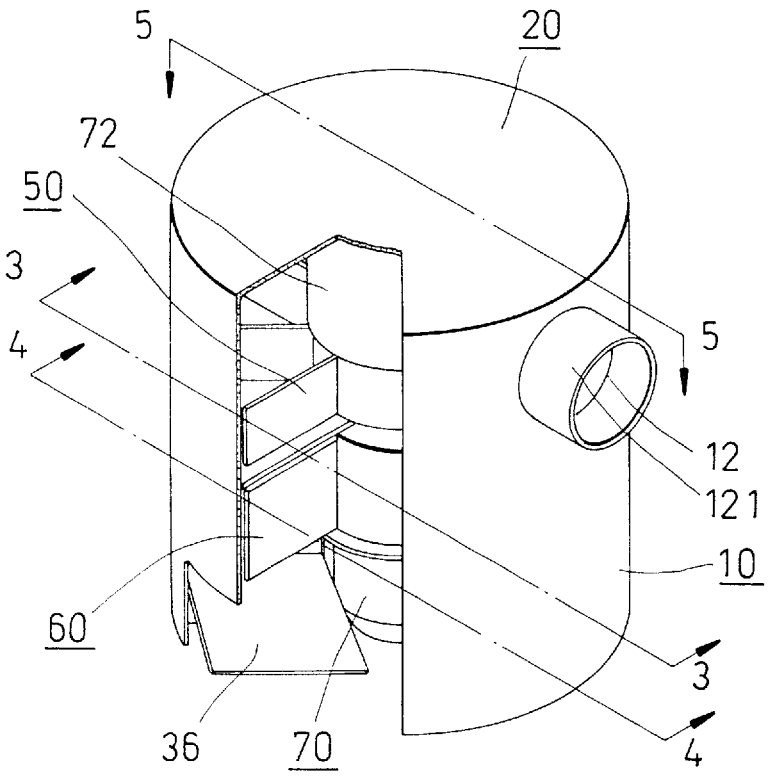
FIG. 2 is a partial sectional view of the present invention in combination.
Figure 3:
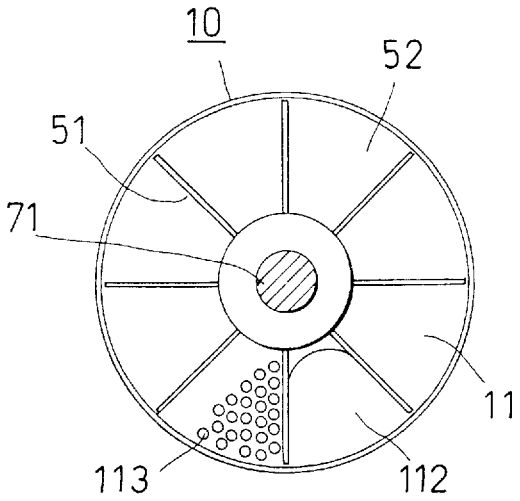
FIG. 3 is a sectional view taken along the direction indicated by a line 3—3 as shown in FIG. 2.

As shown in FIGS. 1–6, a ball feeding device embodied in the present invention is intended for use in feeding the dirty balls into a ball washing machine. The ball feeding device of the present invention is composed of the component parts, which are described explicitly hereinafter.

A cylindrical housing 10 is of a hollow construction and is provided with an open top and an open bottom. The cylindrical housing 10 is further provided therein in the midsegment thereof with an intermediate plate 11 which is in turn provided at the center thereof with a center hole 111, and in the periphery thereof with a first cut 112. The first cut 112 is provided in one side thereof with a plurality of first pores 113. The cylindrical housing 10 is provided in the wall thereof with an admission hole 12 having a tubular portion 121 extending in the direction away from the housing 10. Located in one side of the inner portion of the admission hole 12 is a stopping plate 122 which is located over the junction of the first cut 112 and the first pores 113. It must be noted here that the admission hole 12 is corresponding in location to the first pores 113. The cylindrical housing 10 is still further provided in the wall of the lower open end thereof with a recess 13.

An upper plate 20 is fastened with the top open end of the cylindrical housing 10 such that the top open end of the cylindrical housing 10 is sealed off, and that the upper plate 20 and the intermediated plate 11 form therebetween a first receiving cell 21.

A lower plate 30 is located securely in the interior of the lower segment of the cylindrical housing 10 such that the lower plate 30 and the intermediate plate 11 form therebetween a second receiving cell 31. The lower plate 30 is provided with a plurality of second pores 32 corresponding in location to the first cut 112 and the first pores 113 of the intermediate plate 11. The lower plate 30 is further provided with a second cut 33 and a discharge frame member 34 located under the second cut 33. The distance between an inner edge 331 of the second cut 33 and an outer edge 332 of the second cut 33 is slightly greater than the outer diameter of a soft ball. The lower plate 30 is still further provided with a third cut 35 contiguous to the second cut 33 and corresponding in location to the recess 13 of the cylindrical housing 10. The distance between an inner edge 351 of the third cut 35 of the lower plate 30 and the inner wall of the cylindrical housing 10 is smaller than the outer diameter of the soft ball. Located under the third cut 35 is an inclined guide plate 36. The lower plate 30 is still further provided at the center thereof with a through hole 37.

A suction apparatus comprises the component parts which are described hereinafter.

A case member 40 is fastened to the underside of the lower plate 30 such that the case member 40 is corresponding in location to the second pores 32. The case member 40 has a peripheral portion 41, and a bottom portion 42 which is provided with a plurality of vent holes 421. The case member 40 contains a fan 43.

A first lobed wheel 50 is mounted in the first receiving cell 21 and is composed of a plurality of first lobes 51. Located between the adjacent two first lobes 51 is a first ball cell 52.

A second lobed wheel 60 is mounted in the second receiving cell 31 and is composed of a plurality of second lobes 61. Located between the two adjoining second lobes 61 is a second ball cell 62.

A driving apparatus 70 is fastened with the underside of the lower plate 30 for driving the first lobed wheel 50 and the second lobed wheel 60. The driving apparatus 70 is composed of a shaft 71 on which the first lobed wheel 50 and the second lobed wheel 60 are rotatably mounted. The shaft 71 is received in the through hole 37 of the lower plate 30 and the center hole 111 of the intermediate plate 11. The shaft 71 is provided at one end thereof with a cylindrical member 72 fastened therewith.

Figure 7:
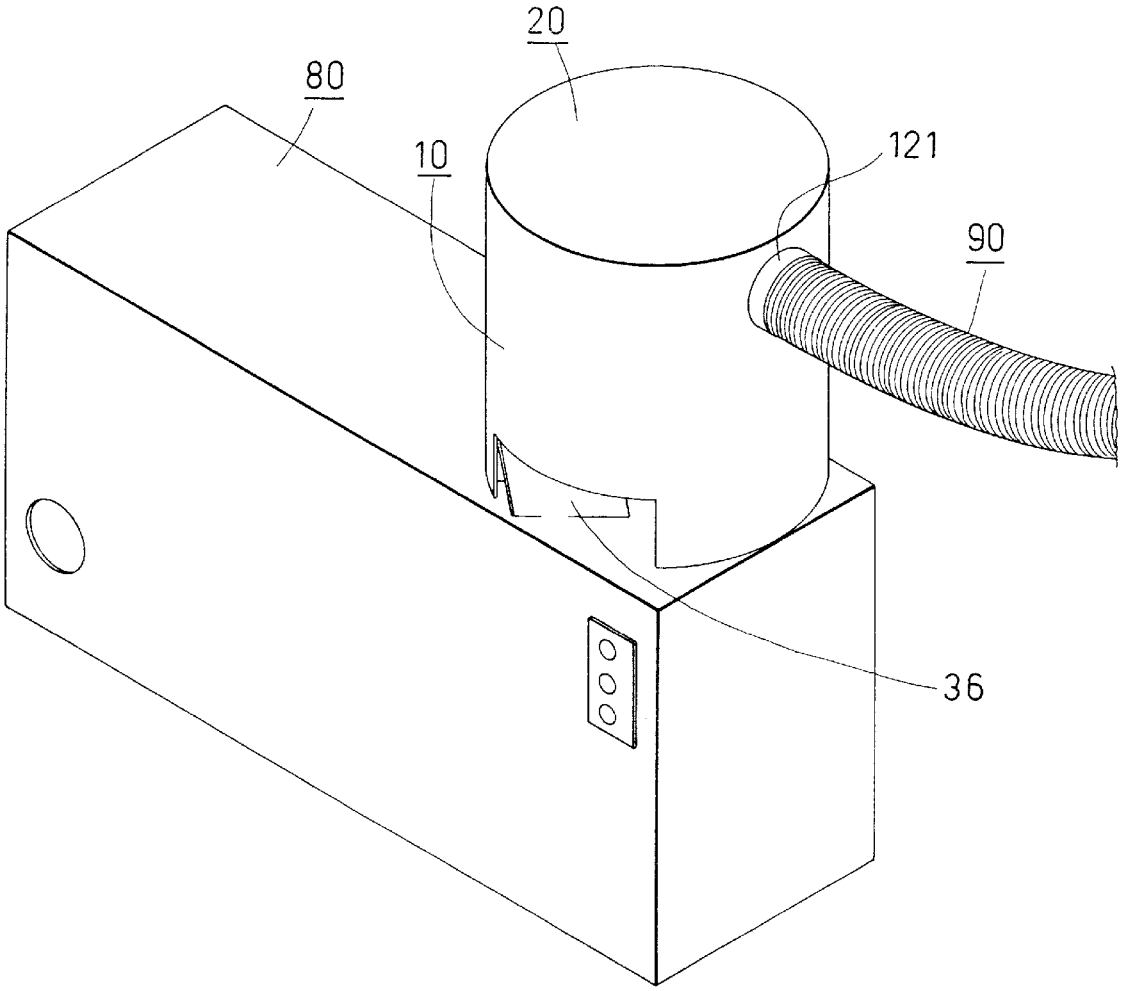
FIG. 7 is a schematic view showing that the ball feeding device of the present invention is mounted on a ball washing machine.
Figure 8:
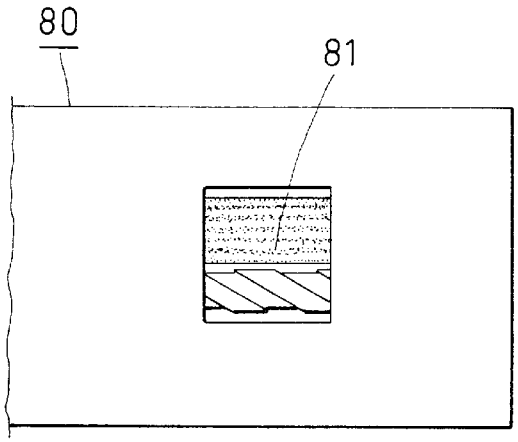
FIG. 8 is a top plan view of the ball washing machine as shown in FIG. 7.
Figure 9:
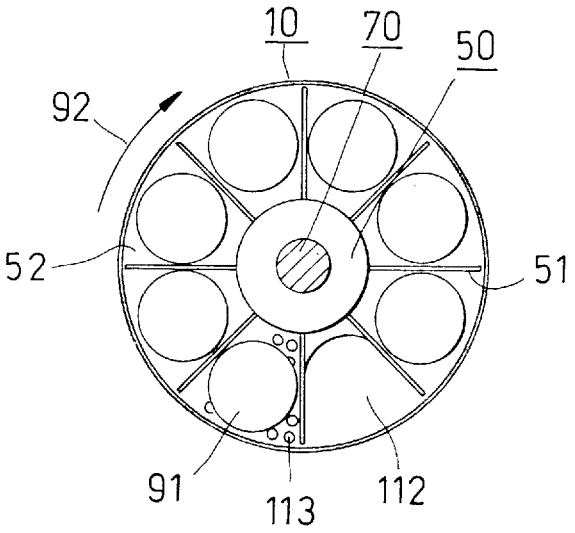
FIG. 9 is a partial schematic view of the present invention at work.
Figure 10:
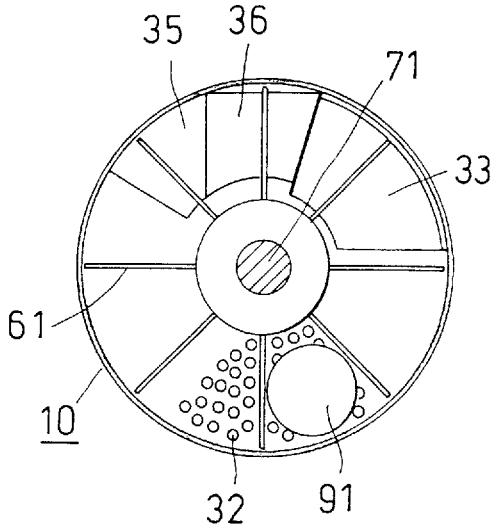
FIG. 10 is another partial schematic view of the present invention at work.

As illustrated in FIG. 7, the ball feeding device of the present invention is mounted on a ball washing machine 80 such that the second cut 33 and the discharge frame member 34 of the ball feeding device are aligned with a ball feeding port 81 of the ball washing machine 80, as shown in FIG. 8. A pliable tube 90 is fastened at one end thereof with the tubular portion 121 of the admission hole 12. As the fan 43 and the driving apparatus 70 are started, the first lobed wheel 50 and the second lobed wheel 60 are driven by the driving apparatus 70 to turn at 25 rpm in the same direction. The fan 43 in motion is capable of generating a suction force enabling the soft balls to be drawn into the pliable tube 90. The action of the suction force is brought about via the second pores 32 and the first pores 113. As the balls are fed into the cylindrical housing 10 via the admission hole 12, the incoming balls are stopped by the stopping plate 122 such that the balls are held in the first ball cells 52 of the first lobed wheel 50, as shown in FIG. 9. The soft balls 91 are moved along with the first lobed wheel 50 in the direction indicated by an arrow 92. As the ball 91 arrives at the first cut 112 of the intermediated plate 11, the ball 91 is drawn into the second ball cell 62 of the second lobed wheel 60, as shown in FIG. 10. As the ball 91 carried by the second lobed wheel 60 arrives at the third cut 35, the ball 91 is prevented from falling in view of the fact that the distance between the inner edge 351 of the third cut 35 and the inner wall of the cylindrical housing 10 is smaller than the outer diameter of the ball 91. The ball 9 is therefore allowed to fall when it arrives at the second cut 33. Subsequently, the ball 91 is fed into the ball washing machine 80 via the discharge frame member 34 and the ball feeding port 81.

Figure 11:
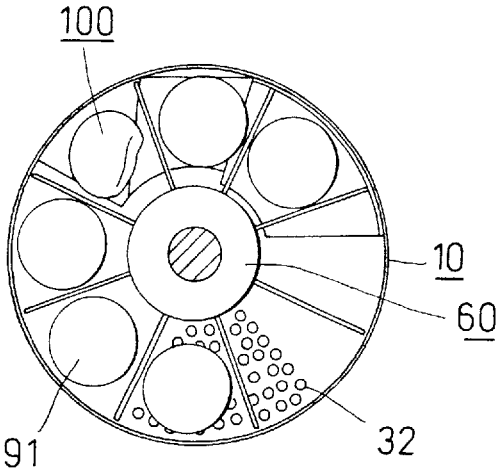
FIG. 11 is still another partial schematic view of the present invention at work.

The ball feeding device of the present invention is capable of eliminating a defective ball 100, as shown in FIG. 11. Since the defective ball 100 has a smaller outer diameter, the defective ball 100 is allowed to fall on the inclined guide plate 36 via the third cut 35.

Figure 4:
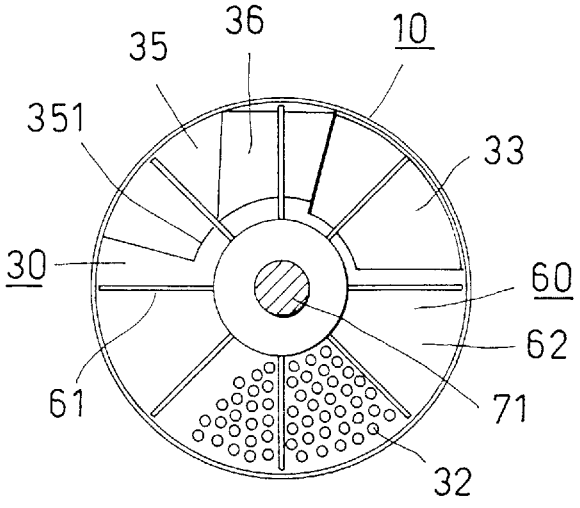
FIG. 4 is a sectional view taken along the direction indicated by a line 4—4 as shown in FIG. 2.
Figure 5:
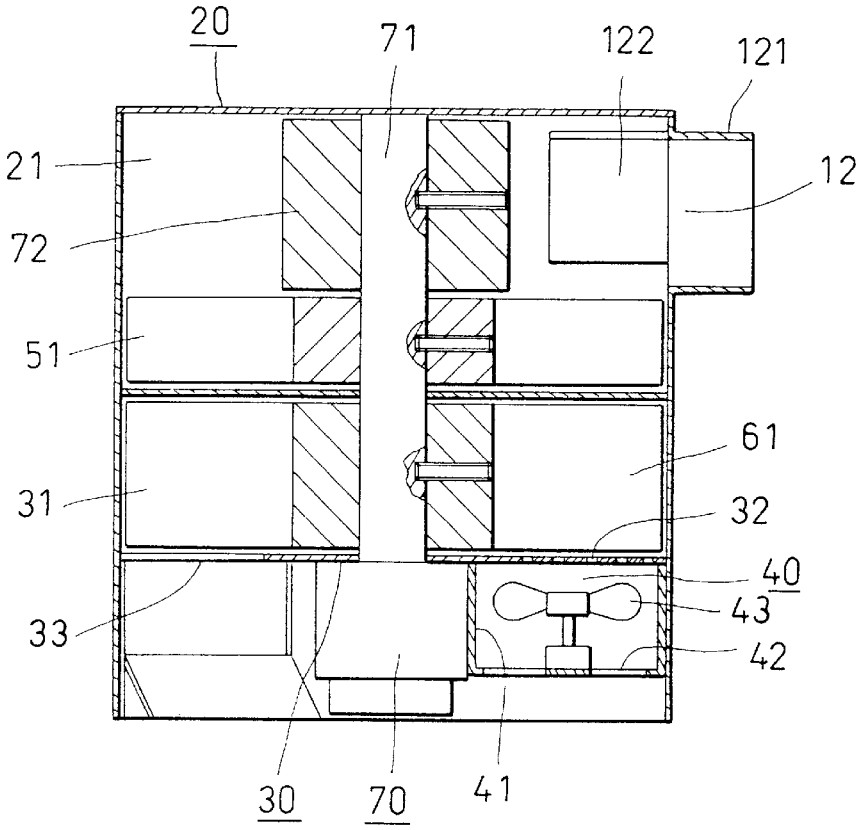
FIG. 5 is a sectional view taken along the direction indicated by a line 5—5 as shown in FIG. 2.
Figure 6:
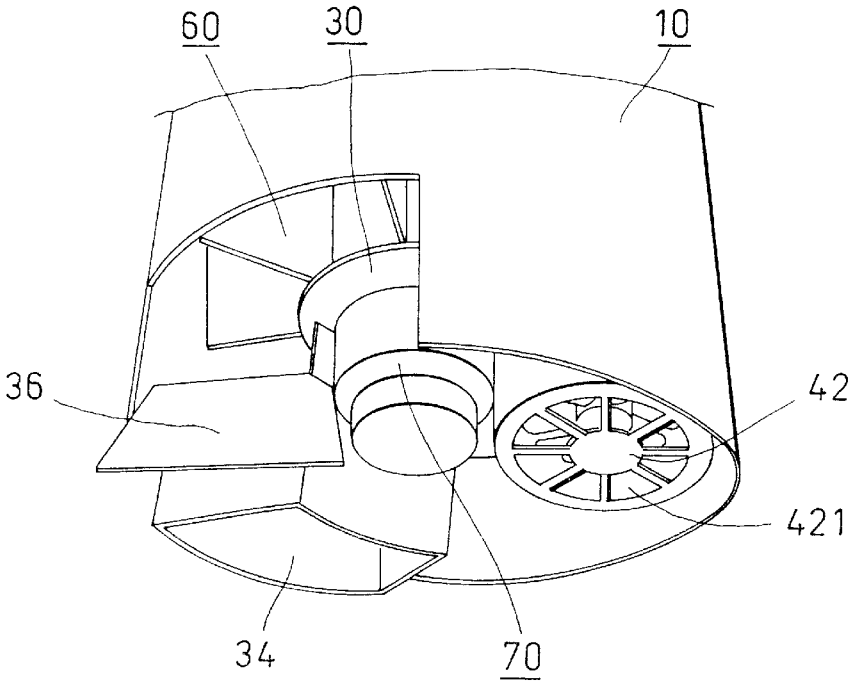
FIG. 6 is a bottom view of the present invention.

As shown in FIG. 4, the suction force generated by the fan 43 is allowed to pass through the second pores 32 and at least two empty second ball cells 62 of the second lobed wheel 60. The top and the bottom edges of the second lobes 61 are very close to the intermediate plate 11 and the bottom plate 30. In addition, the outer edges of the second lobes 61 are also very close to the inner wall of the cylindrical housing 10. Moreover, the distances between the second pores 32 and the second and the third cuts 33, 35 are far greater than the maximum width of the second ball cell 62. As a result, the leak of the suction force from the second receiving cell 31 is minimized. The first receiving cell 21 is airtight to prevent the leak of the suction force. The balls are therefore drawn into the first receiving cell 21 effectively via the admission hole 12 and the pliable tube 90.

What is claimed is:

1. A ball feeding device of a ball washing machine, said ball feeding device comprising:

a cylindrical housing of a hollow construction and provided in a midsegment of a hollow interior thereof with an intermediate plate having a center hole and a first cut in a periphery thereof, said intermediate plate further having a plurality of first pores contiguous to said first cut, said cylindrical housing further provided with a ball admitting hole corresponding in location to said first pores and having a tubular portion extending in a direction away from said cylindrical housing, said ball admitting hole provided with a ball stopping plate located over a junction between said first cut and said first pores;

an upper plate fastened hermetically with a top end of said cylindrical housing such that said upper plate and said intermediate plate form therebetween a first receiving cell;

a lower plate fastened in the hollow interior of a bottom segment of said cylindrical housing such that said lower plate and said intermediate plate form therebetween a second receiving cell, said lower plate provided with a plurality of second pores corresponding in location to said first cut and said first pores of said intermediate plate, said lower plate further provided with a second cut such that the distance between an inner edge of said second cut and an outer edge of said second cut is greater than the outer diameter of a ball, and that said second cut is aligned with a ball feeding port of the ball washing machine, said lower plate further provided at the center thereof with a through hole;

a suction apparatus fastened with the underside of said lower plate such that said suction apparatus is corresponding in location to said second pores;

a first lobed wheel located in said first receiving cell and composed of a plurality of first lobes, and first ball cells formed between two adjoining first lobes;

a second lobed wheel located in said second receiving cell and composed of a plurality of second lobes, and second ball cells formed between two adjoining second lobes; and a driving apparatus fastened with the underside of said lower plate and provided with a shaft on which said first lobed wheel and said second lobed wheel are rotatably mounted, said shaft provided at one end thereof with a cylindrical member fastened therewith.

2. A ball feeding device according to claim 1, wherein said suction apparatus comprises a case member fastened wtih the underside of said lower plate such that said case member is corresponding in location to said second pores, said case member having a peripheral portion and a bottom portion which is provided with a plurality of vent holes, said case member further having a fan for generating a suction force.

3. A ball feeding device according to claim 1, wherein said lower plate is provided with a discharge frame member located under said second cut.

4. A ball feeding device according to claim 2, wherein said lower plate is provided with a discharge frame member located under said second cut.

5. A ball feeding device according to claim 1, wherein said lower plate is further provided with a third cut such that the distance between an inner edge of said third cut and the inner wall of said cylindrical housing is smaller than the outer diameter of the ball.

6. A ball feeding device according to claim 2, wherein said lower plate is further provided with a third cut such that the distance between an inner edge of said third cut and the inner wall of said cylindrical housing is smaller than the outer diameter of the ball.

7. A ball feeding device according to claim 3, wherein said lower plate is further provided with a third cut such that the distance between an inner edge of said third cut and the inner wall of said cylindrical housing is smaller than the outer diameter of the ball.

8. A ball feeding device according to claim 4, wherein said lower plate is further provided with a third cut such that the distance between an inner edge of said third cut and the inner wall of said cylindrical housing is smaller than the outer diameter of the ball.

9. A ball feeding device according to claim 5, wherein said lower plate is provided with an inclined guide plate fastened therewith such that said inclined guide plate is located under said third cut.

10. A ball feeding device according to claim 6, wherein said lower plate is provided with an inclined guide plate fastened therewith such that said inclined guide plate is located under said third cut.

11. A ball feeding device according to claim 7, wherein said lower plate is provided with an inclined guide plate fastened therewith such that said inclined guide plate is located under said third cut.

12. A ball feeding device according to claim 8, wherein said lower plate is provided with an inclined guide plate fastened therewith such that said inclined guide plate is located under said third cut.

* * * * *